United States Patent [19]

Willems et al.

[11] 4,087,387

[45] May 2, 1978

[54] FOAM CLEANING COMPOSITION

[75] Inventors: Albert Willems, Maarssen; Wilhelmus Gerardus Galesloot, Leersum, both of Netherlands

[73] Assignee: Lever Brothers Company, New York, N.Y.

[21] Appl. No.: 684,815

[22] Filed: May 10, 1976

Related U.S. Application Data

[63] Continuation of Ser. No. 483,198, Jun. 26, 1974, abandoned.

[30] Foreign Application Priority Data

Jul. 10, 1973 United Kingdom ..... 32849/73

[51] Int. Cl.[2] ..... C11D 1/88; C11D 1/86; C11D 3/08

[52] U.S. Cl. ..... 252/524; 252/526; 252/527; 252/529; 252/531; 252/534; 252/539; 252/540; 252/542; 252/545; 252/546; 252/153; 252/550; 252/553; 252/558; 252/559; 252/DIG. 14

[58] Field of Search ..... 252/542, 545, 546, 550, 252/553, 559, 526, 547, 524

[56] References Cited

U.S. PATENT DOCUMENTS

| | | | |
|---|---|---|---|
| 3,640,880 | 2/1972 | Martin | 252/555 |
| 3,679,608 | 7/1972 | Aubert et al. | 252/526 |
| 3,755,559 | 8/1973 | Hewitt | 427/70 |
| 3,775,348 | 11/1973 | Jakobi et al. | 252/524 |
| 3,844,952 | 10/1974 | Booth | 252/8.75 |
| 3,883,447 | 5/1975 | Tokiwa et al. | 252/546 |
| 3,928,251 | 12/1975 | Bolich et al. | 252/545 |
| 3,935,130 | 1/1976 | Hirano et al. | 252/542 |

FOREIGN PATENT DOCUMENTS

| | | |
|---|---|---|
| 817,377 | 7/1969 | Canada. |

*Primary Examiner*—P.E. Willis, Jr.
*Attorney, Agent, or Firm*—Melvin H. Kurtz

[57] ABSTRACT

A mild aqueous liquid foam cleaning composition, specially adapted for cleaning the interiors of cars, trainwagons, ships, aircraft and buildings, is provided comprising a specific combination of surface-active agents, solubilizers, and an organic builder.

5 Claims, No Drawings

FOAM CLEANING COMPOSITION

This is a continuation of application Ser. No. 483,198, filed June 26, 1974, now abandoned.

BACKGROUND OF THE INVENTION

1. Field of the Invention

The present invention is concerned with a non-corrosive liquid foam cleaning composition, which is specially adapted for the cleaning of interiors of cars, trainwagons, ships, aircraft and buildings.

The foam cleaning composition of the invention provides effective cleaning for e.g. plastic upholstery, aluminum alloy panels, plastic and aluminium walls and ceilings, and furniture, without causing damage to these items.

2. Description of the Prior Art

The technique of foam cleaning is known and e.g. disclosed in "Food Manufacture" October 1970, pages 37–39. Foam cleaning in industry as disclosed in U.S. Pat. No. 3,037,887 and Canadian Patent Specn. No. 817,377 uses either acid or highly alkaline compositions.

Foam cleaning is normally effected by pumping high-foaming cleaning solutions in a mechanical system in which compressed air is mixed with the cleaning solution to produce a stable foam, and applying the foam to a soiled surface. The "dry" foam clings to the surface to be cleaned, increases the contact time of the liquid with the soil and prevents rapid drying or run-off of the liquid cleaner, thereby dramatically improving the cleaning. Foam cleaning has several advantages. It reduces the amount of solution required for cleaning. It also reduces the cost of labour, time and materials. If interior walls which are partly covered with e.g. perforated plastic materials are cleaned in the conventional way by brushing or wiping, water can penetrate through the holes causing damage to the framework and other materials behind these covers.

DESCRIPTION OF THE INVENTION

The present foam cleaning composition is particularly adapted for the cleaning of interiors and for avoiding the time-consuming method of manually removing the foam layers, which might also cause damage to walls and ceilings. The foam layer produced with the composition of the invention after a certain residence time can be completely removed with a suitable foam suction apparatus.

In summary the aqueous liquid foam cleaning composition of the invention comprises an aqueous solution containing as essential ingredients:

(a) 5 – 15 parts by weight of a high-foaming alkali metal, ammonium, or amine salt of an alkylarylsulphonic acid in which the alkyl group contains from 8–16 carbon atoms; preferably about 12 carbon atoms, for example sodium or ammonium dodecylbenzene sulphonate in which the dodecyl group is straight-chained or branched-chained;

(b) 1 – 10 parts by weight of an alkali metal, ammonium or amine salt of an alkylsulphuric acid in which the alkyl group is straight-chained or branched-chained and contains from 8–18 carbon atoms, for example sodium lauryl sulphate or sodium tallow alcohol sulphate;

(c) 0 – 10 parts by weight of a nonionic ethoxylate as hereinafter defined;

(d) 0 – 5 parts by weight of an amphoteric detergent, such as the betaine types and the imidazolin derivatives;

(e) 1 – 8 parts by weight of a solubiliser selected from the group consisting of alkali metal or ammonium salts of toluene sulphonic acid and xylene sulphonic acid;

(f) 2 – 15 parts by weight of a low molecular weight alcohol comprising 2–4 carbon atoms, such as ethylene glycol and isopropylalcohol;

(g) 0.5–7.5 parts by weight of an organic builder, such as the alkali metal salt of a polyhydroxycarboxylic acid or of an aminocarboxylic acid, e.g. sodium gluconate, the sodium salt of ethylene diamine tetraacetic acid, or the sodium salt of nitrilotriacetic acid;

(h) 0 – 2 parts by weight of sodium metasilicate.

It has been found that the presence of an alkylsulphate detergent (component (b)) in conjunction with the high-forming component (a) is essential to give a proper balance of satisfactory detergency and good foaming characteristics.

Some nonionic surface-active agent is preferably included to give effective fatty soil removal.

A further improvement in the cleaning performance and the foaming characteristics is achieved by the presence of an amphoteric detergent (component (d). Suitable amphoteric detergents which can be used here are e.g. the amido alkylbetaines as disclosed in German Patent Application No. 1,062,392 having the general formula

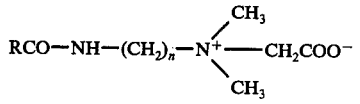

where R = $C_7$–$C_{17}$ alkyl or alkylaryl or $n$ = 2–3, particularly the $C_8$–$C_{18}$ fatty acid amido alkylbetaines.

As desired the high foaming component (a) may be replaced in part or wholly by other known equally high-foaming surface-active agents. As a suitable replacement can be mentioned the well-known high-foaming amphoteric compounds of the imidazoline series known commercially under the trade name "Miranol" of the Minarol Chemical Co. Inc.

These compounds are disclosed in U.S. Pat. Nos. 2,528,378 and 2,773,668 and have the general formula:

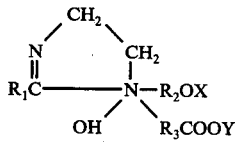

in which $R_1$ is a hydrocarbon radical having from 4 to 18 carbon atoms, $R_2$ is a hydrocarbon radical having from 1 to 4 carbon atoms, $R_3CO$ is an acyl radical having from 1 to 4 carbon atoms, X is Na, K, H, —$CH_2$-COONa, —$CH_2COOK$ or —$CH_2COOH$, and Y is H, Na or K.

In the event that the high-foaming component (a) comprises in part or essentially the above-described amphoteric compound the amount of amphoteric detergent included as component (d) can be reduced or may be even zero.

The nonionic ethoxylate which can be used in the present formulation may be selected from the group consisting of nonionic alkylphenol polyethers of the general formula R-$C_6H_4$-O($C_2H_4O$)$_n$H, where R is an alkyl group having from 6–16 carbon atoms; nonionic condensates of fatty acids and ethylene oxide of the general formula R-CO-O-$(C_2H_4O)_nH$, where R is an alkyl group having from 12–22 carbon atoms and *n* is an integer of from 8 to 20; nonionic condensates of higher straight-chained or branched-chained primary or secondary alcohols and ethylene oxide of the general formula R-$O(C_2H_4O)_nH$ where R is a hydrocarbon group having 10–20 carbon atoms and *n* is an integer of from 8 to 20, and mixtures thereof.

Optimum concentration ranges of the components as aqueous solution in a liquid foam cleaning composition of the invention are:

Component (a) 5 - 10% by weight
Component (b) 2 - 5% by weight
Component (c) 2 - 5% by weight
Component (d) 0.5 - 2% by weight
Component (e) 1 - 5% by weight
Component (f) 3 - 8% by weight
Component (g) 1 - 5% by weight
Component (h) 0 - 1% by weight This liquid foam cleaning composition is generally used as a diluted solution which can be made by mixing with water at a ratio of 1:5 to 1:10, the pH value of the solution after dilution being from 7–11, preferably from 7.5–9.5. A preferred organic builder is sodium gluconate.

An important aspect of the foam cleaning composition of the invention is that it combines a good cleaning effect with non-corrosiveness against metals and a non-stress crazing effect on plastics. Furthermore in view of its mildness staining of carpets and covers on spillage is reduced to a minimum.

The invention is further illustrated by the following specific but non-limiting examples.

EXAMPLE I

A liquid foam cleaning composition comprising an aqueous solution containing by weight:

7.0% sodium dodecylbenzenesulphonate
3.0% nonylphenol condensed with 14 ethylene oxide groups
3.6% sodium tallow alcohol sulphate
3.0% sodium toluenesulphonate
5.0% isopropylalcohol 2.0% sodium gluconate
0.8% fatty acid amido alkylbetaine
(Tego Betaine L 7(*))

was formulated.

(*) Registered trade mark of Goldschmidt AG, ESSEN

This liquid composition mixed with 5 times its weight of water showed a pH-value of 7.5 and produced a stable foam when mixed with air.

The foam produced was applied onto naturally soiled perforated aluminium ceiling plates. After a contact time of 10 minutes, the foam was conveniently removed using a "Minuteman" foam suction apparatus, leaving the ceiling plates perfectly clean.

"Minuteman" is a registered trade mark of the American Cleaner Corporation.

EXAMPLE II

Another liquid foam cleaning composition was formulated comprising an aqueous solution containing by weight:

7.0% sodium dodecylbenzene sulphonate
3.0% nonylphenol condensed with 14 ethylene oxide groups
3.5% sodium tallow alcohol sulphate
3.0% sodium toluene sulphonate
8.0% isopropyl alcohol
0.5% sodium nitrilotriacetic acid
0.8% fatty acid amino alkylbetaine.
(Tego Betaine L 7(*))

This composition when mixed with 5 times its weight of water showed a pH value of 10.5 and produced a stable foam when mixed with air.

The foam produced was applied onto naturally soiled perforated white plastic ceiling plates. After a contact time of about 10 minutes, the foam was removed with a "Minuteman" foam suction apparatus, leaving the plates adequately clean, without the need of after-treatment.

EXAMPLE III

Liquid foam cleaning composition:

| Components: | % by weight |
|---|---|
| Sodium dodecylbenzene sulphonate | 4.0 |
| Miranol-C2m-SF* | 3.0 |
| Tallow alcohol-18 ethylene oxide | 3.0 |
| Sodium lauryl sulphate | 2.5 |
| Potassium xylene sulphonate | 3.0 |
| Isopropyl alcohol | 5.0 |
| Sodium gluconate | 2.0 |
| Fatty acid amido alkylbetaine (Tego Betaine L7(*)) | 0.5 |
| Water | up to 100.0 |

*Dicarboxylic coconut fatty acid cycloimidate, a registered trademark of the Miranol Chemical Co. Inc.

This composition is ready for use after dilution with 5–10 times its weight of water.

EXAMPLE IV

Liquid foam cleaning composition:

| Components: | % by weight |
|---|---|
| Sodium dodecylbenzene sulphonate | 5.0 |
| Miranol-C2M-SF* | 4.0 |
| Tergitol 15-S-9** | 3.0 |
| Sodium tallow alcohol sulphate | 2.5 |
| Sodium toluene sulphonate | 3.0 |
| Isopropyl alcohol | 6.0 |
| Sodium gluconate | 2.0 |
| Sodium metasilicate | 0.1 |
| Rest water | |

*Dicarboxylic coconut fatty acid cycloimidate, a registered trademark of The Miranol Chemical Co. Inc.
**$C_{10}$–$C_{15}$ secondary alcohol + 9 ethylene oxide, a registered trademark of the Union Carbide Company.

This composition is ready for use after dilution with 5–10 times its weight of water.

What is claimed is:

1. A non-corrosive liquid foam cleaning composition for the production of foam specially adapted for cleaning the interiors of cars, train-wagons, ships, aircraft and buildings, consisting essentially of an aqueous solution of:

(a) from 4 to 15 parts by weight of a high foaming alkali metal, ammonium or amine salt of an alkyl benzene sulphonic acid, in which the alkyl group contains from 8 - 16 carbon atoms;
(b) from 1 to 10 parts by weight of an alkali metal, ammonium or amine salt of an alkyl sulphuric acid, in which the alkyl group is straight-chained or branched-chained and contains from 8 - 18 carbon atoms;
(c) from 2 to 10 parts by weight of a nonionic ethoxylate selected from the group consisting of nonionic alkylphenol polyethers of the general formula R-$C_6H_4$-$O(C_2H_4O)_nH$, where R is an alkyl group having from 6 – 16 carbon atoms; nonionic condensates of fatty acids and ethylene oxide of the general formula $R\text{-}CO\text{-}O\text{-}(C_2H_4O)_nH$, where R is an alkyl group having 12 – 22 carbon atoms and *n* is an integer of from 8 to 20; nonionic condensates of higher straight-chained or branched-chained primary or secondary alcohols and ethylene oxide of the general formula $R\text{-}O(C_2H_4O)_nH$, where R is a hydrocarbon group having 10 – 20 carbon atoms and *n* is an integer of from 8 to 20, and mixtures thereof;

(d) from 0.5 to 5 parts by weight of an amphoteric detergent selected from the group consisting of amido alkylbetaines having the general formula:

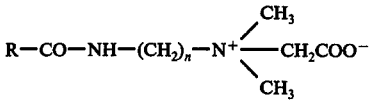

where R is a $C_7$–$C_{17}$ alkyl or alkyl aromatic group, and *n* is 2 – 3; imidazoline compounds having the general formula:

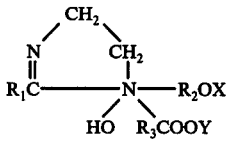

in which $R_1$ is a hydrocarbon radical having from 4 to 8 carbon atoms, $R_2$ is a hydrocarbon radical having 1 – 4 carbon atoms, $R_3CO$ is an acyl radical having 1 – 4 carbon atoms, X is Na, K, H, $—CH_2COONa$, $—CH_2COOK$ or $—CH_2COOH$, and Y is H, Na or K, or mixtures thereof;

(e) from 1 to 8 parts by weight of a solubiliser selected from the group consisting of alkali metal or ammonium salts of toluene sulphonic acid and xylene sulphonic acid;

(f) from 2 to 15 parts by weight of a low molecular weight alcohol comprising 2 – 4 carbon atoms;

(g) from 0.5 to 7.5 parts by weight of an organic builder selected from the group consisting of the alkali metal salts of gluconic acid, ethylene diamine tetraacetic acid, and nitrilotriacetic acid, and mixtures thereof;

(h) from 0 to 2 parts by weight of sodium metasilicate, said aqueous solution having a pH value of 7 – 11.

2. A liquid foam cleaning composition according to claim 1 comprising;

5 – 10% by weight of component (a)
2 – 5% by weight of component (b)
2 – 5% by weight of component (c)
0.5 – 2% by weight of component (d)
1 – 5% by weight of component (e)
3 – 8% by weight of component (f)
1 – 5% by weight of component (g)
0 – 1% by weight of component (h)

3. A liquid foam cleaning composition according to claim 2, wherein component (a) is an alkali metal salt of an alkylbenzene sulphonic acid, in which the alkyl group contains about 12 carbon atoms.

4. A liquid foam cleaning composition according to claim 2, wherein component (f) is isopropyl alcohol.

5. A liquid foam cleaning composition according to claim 2, wherein component (g) is sodium gluconate.

* * * * *